US005158520A

United States Patent [19]

Lemke et al.

[11] Patent Number: 5,158,520

[45] Date of Patent: Oct. 27, 1992

[54] RESISTANCE TRAINING APPARATUS FOR SQUAT EXERCISES

[76] Inventors: William E. Lemke, 2022 E. Marion St., Shorewood, Wis. 53211; Gregory G. Reshel, 1121 E. Hamilton St., Milwaukee, Wis. 53202; Edward H. Yewer, Jr., 6259 N. Highway 83, Hartland, Wis. 53029; William D. Palin, 2312 E. Kensington Blvd., Shorewood, Wis. 53211

[21] Appl. No.: 707,705

[22] Filed: May 30, 1991

[51] Int. Cl.[5] ..... A63B 21/00

[52] U.S. Cl. ..... 482/133; 482/103; 482/105

[58] Field of Search ..... 272/116, 117, 118, 119, 272/123, 142, 146; 482/92, 94, 98, 99, 102, 103, 105, 133, 139, 146, 147

[56] References Cited

U.S. PATENT DOCUMENTS

| | | | |
|---|---|---|---|
| 3,598,404 | 8/1971 | Bowman | 272/146 |
| 3,751,031 | 8/1973 | Yamauchi | 272/119 |
| 4,531,727 | 7/1985 | Pitre | 272/143 X |
| 4,589,658 | 5/1986 | Gibson | 272/119 X |
| 4,674,160 | 6/1987 | Gibson | 272/143 X |

FOREIGN PATENT DOCUMENTS

| | | | |
|---|---|---|---|
| 687153 | 2/1953 | United Kingdom | 272/117 |

*Primary Examiner*—Robert Bahr

*Attorney, Agent, or Firm*—Andrus, Sceales, Starke & Sawall

[57] ABSTRACT

A resistance apparatus for use in performing squat exercises, in which a belt-type device is worn by a person for providing a resistance connection between the person's legs. The resistance apparatus includes a chain, which is connectable at one end to a connection arrangement associated with the belt-type device. The other end of the chain is connected to a stack of weights or any other satisfactory resistance-providing device, with the chain being trained around a series of pulleys. A tracking arrangement provides front-to-rear movement of the chain at a point below the connection of the chain to the belt-type device for maintaining the resistance directly below the person's center of gravity as the person moves in a front-to-rear direction during performance of a squat exercise.

7 Claims, 2 Drawing Sheets

FIG. 3
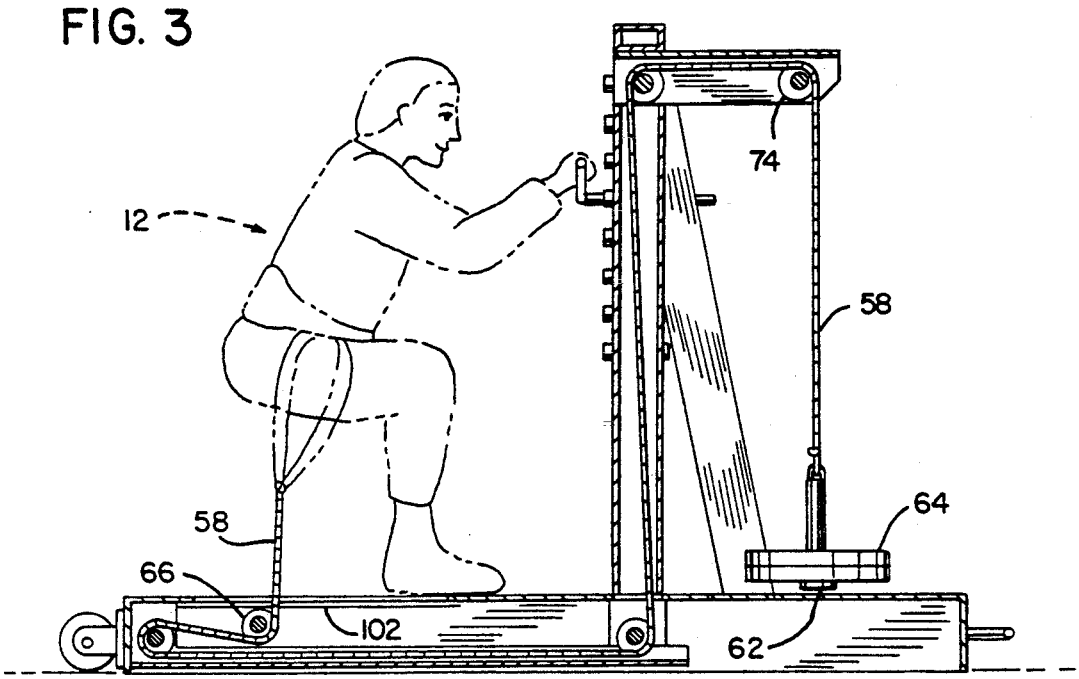
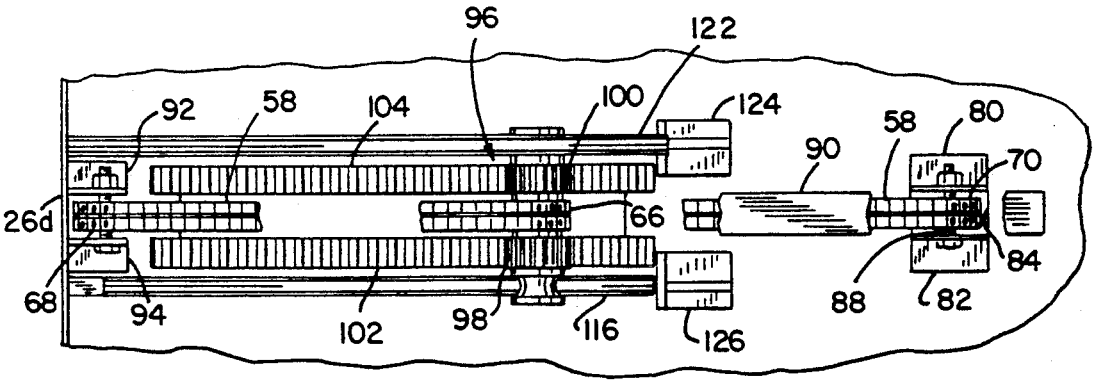
FIG. 4
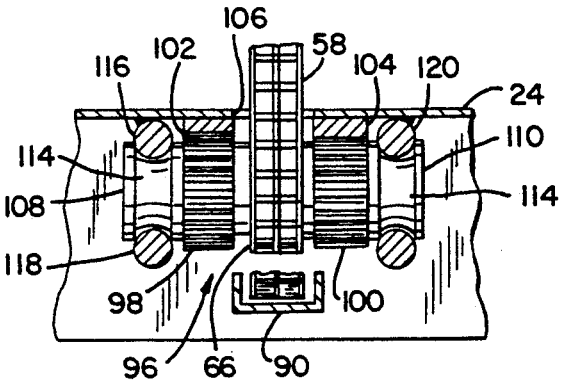
FIG. 5

RESISTANCE TRAINING APPARATUS FOR SQUAT EXERCISES

BACKGROUND OF THE INVENTION

This invention pertains to resistance train. devices, and more particularly to a resistance training device for use in performing squat exercises.

Squat exercises are often an important part of a conditioning or rehabilitation program to strengthen the muscles of a person's lower body. In the past, squat exercises have been performed by a person balancing a weight bar on the shoulders behind the neck, and thereafter squatting while supporting the weight in this manner. This approach presents numerous drawbacks, most notably if the person has an injured back or does not have sufficient back strength to support enough weight to properly exercise the muscles stressed by squat exercises.

The problems associated with squat exercises have been recognized and addressed in development of a belt-type weight-supporting device shown and described in U.S. Pat. No. 4,984,786 entitled "WEIGHT SUSPENSION APPARATUS FOR SQUAT EXERCISES" issued Jan. 15, 1991, which is hereby incorporated by reference. This patent discloses a belt-type device which enables a weight to be suspended from a person's waist and located between the person's legs during performance of a squat exercise. This removes the person's upper body from bearing any weight, and ensures that the muscles of the person's lower body bear all the weight during performance of the exercise.

An important feature provided by the weight-bearing device shown in U.S. Pat. No. 4,984,786 is that the location of the point of connection of the weight is maintained below the user's center of gravity during the back-and-forth movement provided by performance of a squat exercise. This feature eliminates incidental stresses on the person's musculosketal system, ensuring that the weight is borne only by the muscles stressed during performance of a squat exercise.

In addition, U.S. Pat. No. 4,984,786 shows and describes a person performing a squat exercise by suspending weights between the legs, and standing on blocks or pedestals, in order to provide clearance for the weights during performance of the exercise.

It is an object of the present invention to eliminate the need for a person to stand on pedestals to perform a squat exercise when using a weight suspending device in which the weight is located between the person's legs.

It is a further object of the invention to provide a resistance apparatus which is engageable with a connection arrangement such as provided on a belt-type device, and which provides front-to-rear tracking to maintain the resistance below the user's center of gravity during performance of a squat exercise.

It is a further object of the invention to provide a unitary structure for assisting a person in performing a squat exercise, addressing the preceding objects.

The invention contemplates a resistance apparatus for use in a squat exercise system, wherein a belt-type device is worn by a user and includes a connection arrangement located between the user's legs and in which the connection arrangement moves along with the user in a back-and-forth manner during performance of a squat exercise. In accordance with the invention, the resistance apparatus provides a flexible elongated element which is engageable at a first one of its ends with the connection arrangement of the belt-type device. A resistance arrangement is interconnected with the flexible elongated element, to provide resistance to the belt-type device when the first end of the elongated element is engaged with the belt-type device connection arrangement. The resistance arrangement may take the form of weights connected to the second end of the flexible elongated element, or a brake-type resistance mechanism interconnected with the flexible elongated element. The resistance apparatus further includes a tracking arrangement for the flexible elongated element, to provide back-and-forth movement of the flexible elongated element at a point below its engagement with the belt-type device connection arrangement during performance of a squat exercise. The resistance apparatus preferably includes a platform on which the user stands, with the platform including a slot in which the flexible elongated element moves in a back-and-forth manner during the squat exercise.

In the disclosed embodiment of the invention, the flexible elongated element is a chain, which is trained about a series of sprockets between the weights and the belt-type device connection arrangement. The tracking arrangement comprises a sprocket mounted between a pair of gears, with the gears being engaged with parallel linear gear tracks. The gear tracks are mounted to the underside of an upper panel associated with the platform of the resistance apparatus.

The invention further contemplates a squat exercise system consisting of a belt device in combination with a resistance apparatus, both as summarized above, as well as a method of providing resistance during performance of a squat exercise, substantially in accordance with the foregoing summary.

Further objects, features and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 3 is a view similar to FIG. 2, showing the user in a full-down position during performance of a squat exercise;

FIG. 4 is a partial bottom plan view showing the tracking system of the resistance apparatus of the invention, with reference being made to line 4—4 of FIG. 2; and FIG. 5 is a partial sectional view taken along line 5—5 of FIG. 2.

DETAILED DESCRIPTION OF THE INVENTION

Figure 1:
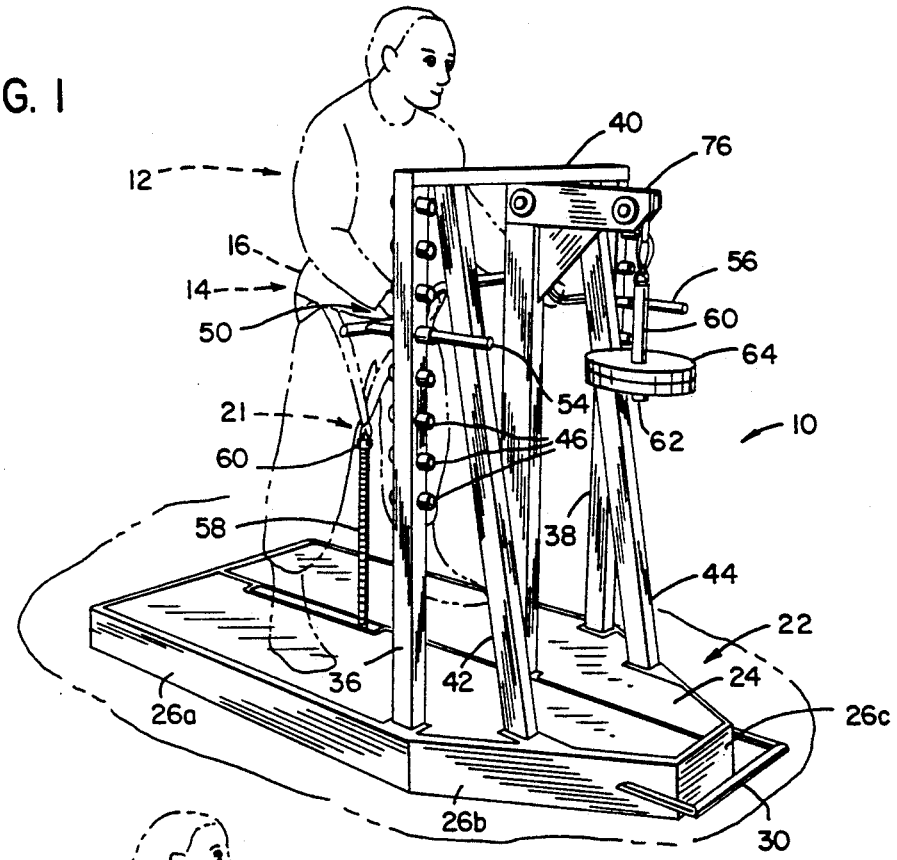
FIG. 1 is an isometric view showing a prototypical resistance apparatus of the invention.
Figure 2:
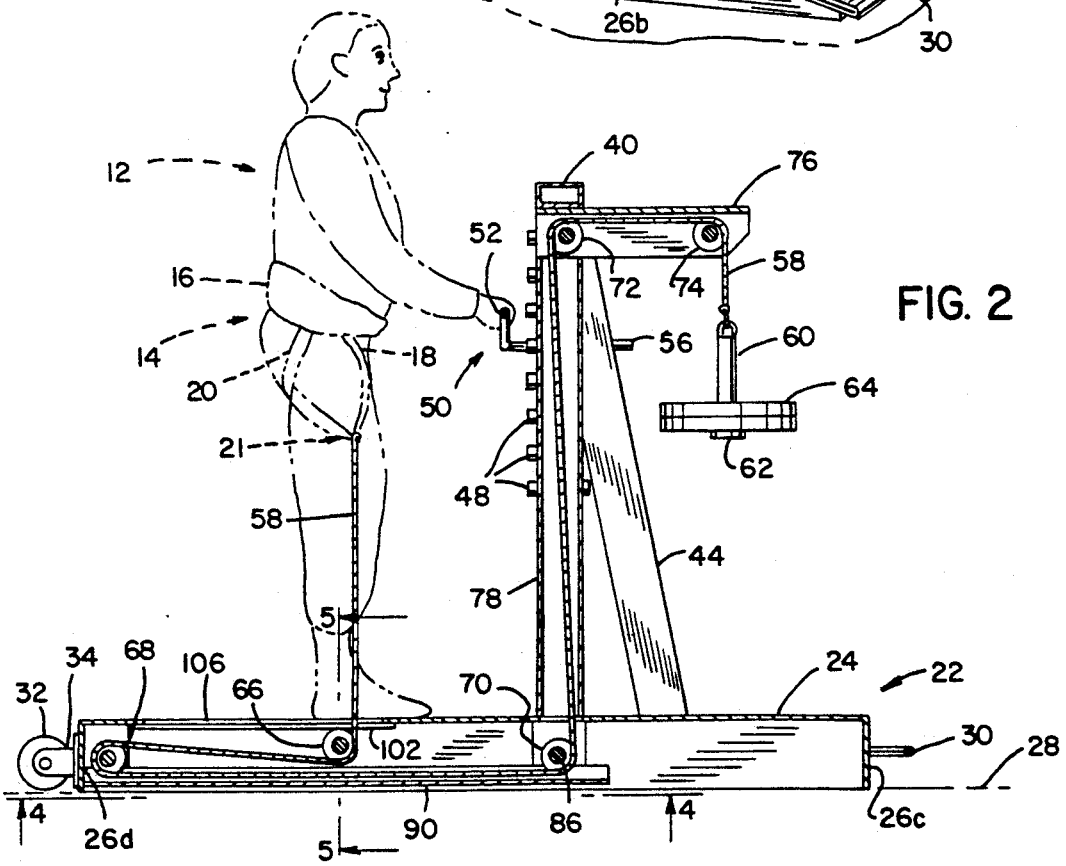
FIG. 2 is a sectional elevation view showing the resistance apparatus of FIG. 1, and showing the user in an upright position.

Referring to FIGS. 1 and 2, a resistance apparatus 10 is illustrated, which provides resistance for a person, shown in phantom at 12, during performance of a squat exercise. The person 12 is shown wearing a belt-type weight suspension device 14, such as that disclosed in U.S. Pat. No. 4,984,786. Weight suspension device 14 generally includes a heavy belt 16 to which front and rear V-shaped straps 18, 20, respectively, are connected. The nadirs of straps 18, 20 are located between the person's legs, and a weight connecting arrangement 21 is provided to suspend a weight from the nadirs of straps 18, 20. Reference is made to U.S. Pat. No. 4,984,786 for a more detailed description of weight suspension device 14 and its connecting arrangement.

Resistance apparatus 10 as illustrated in the drawing figures is a prototype device for providing resistance during performance of a squat exercise. Numerous changes to apparatus 10 are contemplated, some of which will be set forth following the description of apparatus, but apparatus 10 as illustrated satisfactorily embodies the principles of the present invention.

Resistance apparatus 10 includes a platform structure, shown generally at 22, which includes an upper panel 24 and a series of side walls, such as shown at 26*a*, 26*b*, 26*c* (FIG. 1) and 26*d* (FIG. 2). The side walls 26*a*–26*d* support upper panel 24 above a supporting surface, such as a floor 28. A handle 30 is connected to the side walls, such as 26*b*, and a pair of wheels 32 are connected to the rear side wall 26*d*, by means of a pair of brackets 34. With this arrangement, a person can transport resistance apparatus 10 from one location to another by grasping handle 30 and tilting platform structure 22 upwardly so that wheels 32 engage floor 28, and thereafter transporting apparatus 10 by means of wheels 32 to a desired location on floor 28.

Resistance apparatus 10 is provided with a pair of uprights 36, 38, located one on either side of platform structure 22 and extending upwardly from platform upper panel 24. Uprights 36, 38 are connected together at their upper ends by means of a cross member 40. A pair of brace members 42, 44 extend between cross member 40 and platform upper panel 24, for providing stability to uprights 36, 38.

Referring to FIG. 1, upright 36 is provided with a series of tube members 46 located at equally spaced intervals throughout the upper portion of upright 36. Referring to FIG. 2, upright 38 is similarly provided with a series of equally spaced tube members 48 in its upper portion. A handle assembly, shown generally at 50, includes a handle bar 52 which is adapted to be grasped by person 12 during performance of a squat exercise, and a pair of horizontal members 54, 56 which extend forwardly from handle bar 52. Horizontal members 54, 56 are adapted to be inserted through selected ones of tube members 46, 48, respectively, to provide mounting of handle assembly 50 to uprights 36, 38 at varying vertical positions relative to platform upper panel 24. In this manner, persons of varying heights can use resistance apparatus 10, and the position of handle assembly 50 can be adjusted according to the person's needs.

During performance of a squat exercise by person 12, a downward force is exerted by person 12 on handle member 52, resulting in horizontal members 54, 56 engaging the ends of tube members 46, 48, respectively to maintain handle assembly 50 in position on uprights 36, 38.

With continued reference to FIGS. 1 and 2, resistance apparatus 10 further includes a flexible elongated element in the form of a chain 58. One end of chain 58 is provided with a ring 60 which is adapted to be engaged with connecting arrangement 21 associated with straps 18, 20 of belt-type device 14. The other end of chain 58 is connected to a weight suspension device, which includes a post 60 and a base 62. Post 60 extends through a series of weights, such as shown at 64, which are supported by base 62. In this manner, resistance is provided to belt-type weight suspension device 14 through chain 58 by weights 64.

Between its ends, chain 58 is trained around a tracking sprocket 66, and a series of idler sprockets 68, 70, 72, and 74.

Idler sprocket 74 is located toward the outer end of a cantilevered upper member 76 which is connected at its rear end to the underside of cross member 40. Idler sprocket 72 is located at the inner end of cantilevered upper member 76. A tube member 78 extends vertically between the underside of upper member 76 at its inner end, and upper panel 24 of platform structure 22. Chain 58 is wrapped around idler sprockets 72 and 74, and extends downwardly through vertical tube member 78 to idler sprocket 70, where it is enclosed by upper panel 24 and the side walls of platform structure 22. From idler sprocket 70, chain 58 extends rearwardly to rear idler sprocket 68, and is wrapped around idler sprocket 68 extending forwardly therefrom to tracking sprocket 66. Chain 58 is wrapped around tracking sprocket 66, and extends upwardly for connection to straps 18, 20 of belt-type weight suspension device 14.

Reference is now made to FIGS. 4 and 5, which illustrate the chain engaging components associated with the interior of platform structure 22. As shown in FIG. 4, idler sprocket 70 is mounted between a pair of brackets 80, 82 welded to the underside of platform upper panel 24. An opening 84 is formed in platform upper panel 24, for allowing chain 58 to pass from the interior of vertical tubular member 78 through panel 24 into the interior of platform structure 22. Idler sprocket 70 is mounted to a bearing assembly, such as shown in FIG. 2 at 86, and is maintained in position by a bolt 88 (FIG. 4) extending between the vertical portions of brackets 80, 82 through bearing assembly 86.

The run of chain 58 extending between idler sprockets 68 and 70 is enclosed by a chain guard member 90 (FIGS. 2–5).

Rear idler sprocket 68 is mounted between a pair of brackets 92, 94 (FIG. 4) in a manner similar to front idler sprocket 70. Brackets 92, 94 are mounted in the interior of platform structure 22 such as by welding to the underside of platform upper panel 24 and the inner surface of rear side wall 26*d*.

Tracking sprocket 66 comprises the central portion of a tracking member shown in FIGS. 4 and 5 generally at 96. Tracking member 96 includes a pair of circular toothed gears 98, 100 located one on either side of tracking sprocket 66, which are engageable with a pair of linear gear tracks 102, 104, respectively. Gear tracks 102, 104 consist of straight bars, each of which is provided with transverse gear teeth along its length, and which are welded to the underside of platform upper panel 24 one on either side of an elongated tracking slot 106 formed in panel 24. A pair of guide rollers 108, 110, extend outwardly from gears 98, 100, respectively. Guide rollers 108, 110 each include a circumferential concave groove, shown at 112, 114, respectively. Upper and lower guide rails 116, 118 are engaged within groove 114 of guide roller 108, and upper and lower guide rails 120, 122 are engaged within groove 114 of guide roller 110. Guide rails 116–122 extend beyond the ends of gear tracks 102, 104, and are mounted at one end to the inner surface of rear side wall 26*d*, and at the other end to a vertical member associated with brackets 124, 126, respectively, mounted to the underside of platform upper panel 24.

In operation, resistance apparatus 10 functions as follows. Initially, base 62 of the weight supporting assembly is placed on platform upper panel 22, and a desired number of weights 64 are placed on post 60 above base 62. The end of chain 58 is then attached to the upper portion of post 60, which includes an inverted U-shaped member for receiving a hook or the like provided at the end of chain 58. The person then assumes a squat position such as shown in FIG. 3, and connects the other end of chain 58 to connection arrangement 21 provided at the nadirs of front and rear straps 18, 20, respectively of weight supporting device 14, which is worn by the user. The user grasps handle portion 52 of handle assembly 50, after it has been placed in an appropriate vertical position, for assistance in attaining the squat position as shown in FIG. 3. After the weight has been connected as described, the person then moves to an upright position as shown in FIG. 2, which results in drawing upwardly the portion of chain 58 located below idler roller 74, and thereby raising of weights 64, which provide resistance during this portion of the squat exercise. As the person moves to the upright position, chain 58 is pulled upwardly about tracking sprocket 66, which results in forward movement of tracking sprocket 66 due to engagement of the teeth of gears 98, 100 with gear tracks 102, 104. Guide members 108, 110 and guide rails 116–122 maintain gears 98, 100 in a proper lateral position, ensuring that the teeth of gears 98, 100 remain engaged with the teeth of gear tracks 102, 104.

When the person is in the upright position, such as shown in FIG. 2, the downward force exerted by chain 58 is substantially vertical, and the point at which chain 58 is connected to connecting arrangement 21 is located directly below the person's center of gravity. From the position as shown in FIG. 2, the person then squats to resume the position as shown in FIG. 3, resulting in backward movement of connection arrangement 21 associated with belt-type weight supporting device 14. The weight provided by weights 64 draws chain 58 downwardly during this portion of the exercise, resulting in rearward movement of tracking sprocket 66 on gear tracks 102, 104. As the person squats, moving his center of gravity rearwardly, to assume the FIG. 3 position, the downward force exerted by chain 58 on the person remains substantially vertical.

With the forward and rearward tracking of the portion of the chain 58 connected to straps 18, 20, the downward force provided by chain 58 is maintained directly below the person's center of gravity during the entire range of front-to-rear motion of the person during performance of a squat exercise.

It is contemplated that several modifications to resistance apparatus 10 may be made. For one, uprights 36, 38 and handle assembly 50 may be replaced by a single vertical panel on which are mounted two hand rails, which are close together at their upper ends and diverge away from each other toward their lower ends. This provides a hand grip at varying elevations for accommodating users of different heights. Further, a brake-type resistance mechanism could be installed below platform upper panel 22, interconnected with chain 58, this eliminating weights 64 and the weight suspension device. This modification would provide resistance during that portion of the squat exercise in which the person moves from a squatting position to an upright position, which is the main portion of the exercise which stresses the muscles of the person's lower body. Further, a selectively actuable locking device could be installed for maintaining the weights 64 in any desired position. This would allow the user to attach the end of chain 58 to straps 18, 20 when the person is in an upright standing position, and also would enable the user to eliminate the resistance provided by the weights at any time during performance of the exercise. The actuating lever of the locking device would be located near the handle assembly for convenience and accessibility.

Various alternatives and embodiments are contemplated as being with the scope and spirit of the following claims particularly pointing out and distinctly claiming the subject matter regarded as the invention.

We claim:

1. A method of providing resistance during performance of a squat exercise by a user, wherein a belt-type device is worn by the user and includes a connection arrangement located between the user's legs, wherein the connection arrangement moves along with the user in a back-and-forth manner during performance of a squat exercise by the user, the method comprising the steps of:

providing a platform on which the user stands when performing the squat exercise;

providing a flexible elongated element defining a first end and a second end;

engaging the first end of the flexible elongated element with the connection arrangement and engaging the second end of the flexible elongated element with a resistance-providing element;

providing movement of the resistance-providing element in a back-and-forth manner below the engagement of the resistance-providing element with the connection arrangement, by providing a tracking arrangement maintained at a constant predetermined elevation below the user and relative to the platform, the tracking arrangement including a member movable in a back-and-forth manner along with the user during performance of a squat exercise by the user, wherein the resistance-providing element moves in a back-and-forth manner along with the user during performance of a squat exercise by the user.

2. A method of providing resistance during performance of a squat exercise, wherein the user stands on a platform during performance of the exercise and wherein a belt-type device is worn by the user and includes a connection arrangement located between the user's legs, wherein the connection arrangement moves along with the user in a back-and-forth manner during performance of a squat exercise by the user, the method comprising the steps of:

engaging a resistance-providing element with the connection arrangement of the belt-type device by providing a flexible elongated element and connecting one of its ends to the connection arrangement of the belt-type device, wherein resistance is provided by engaging one or more weights with a second end of the flexible elongated element;

engaging the flexible elongated element with a series of idler members; and providing movement of the resistance-providing element in a back-and-forth manner below the engagement of the resistance-providing element with the connection arrangement by providing a tracking arrangement in the platform maintained at a constant predetermined elevation below the user, the tracking arrangement including a member movable in a back-and forth manner along with the user during performance of a squat exercise by the user.

3. The method of claim 2, wherein the platform includes weight-supporting structure, and further comprising the step of interconnecting the flexible elongated element with the weight-supporting structure, wherein one or more weights are suspended from a second end of the flexible elongated element and supported by the weight-supporting structure.

4. A method of providing resistance during performance of a squat exercise by a user, wherein a belt-type device is worn by the user and includes a connection arrangement located between the user's legs, wherein the connection arrangement moves along with the user in a back-and-forth manner during performance of a squat exercise by the user, the method comprising the steps of:

providing a flexible elongated element defining a first end and a second end;

engaging the first end of the flexible elongated element with the connection arrangement and engaging the second end of the flexible elongated element with a resistance-providing element;

training the flexible elongated element about a series of idler members; and providing movement of the flexible elongated element in a back-and-forth manner below its engagement with the connection arrangement, wherein the first end of the flexible elongated element moves along with the user during performance of a squat exercise by the user.

5. The method of claim 4, wherein the step of providing movement of the flexible elongated element in a back-and-forth manner comprises engaging the flexible elongated member, below its engagement with the connection arrangement, with a tracking member mounted for back-and-forth movement to a stationary track.

6. A method of providing resistance during performance of a squat exercise by a user, wherein a belt-type device is worn by the user and includes a connection arrangement located between the user's legs, wherein the connection arrangement moves along with the user in a back-and-forth manner during performance of a squat exercise by the user, the method comprising the steps of:

providing a flexible elongated element defining a first end and a second end;

engaging the first end of the flexible elongated element with the connection arrangement and engaging the second end of the flexible elongated element with a resistance-providing element;

providing a platform on which the user stands when performing the squat exercise;

training the flexible elongated element about one or more idler members disposed below the platform; and providing movement of the flexible elongated element in a back-and-forth manner below its engagement with the connection arrangement, wherein the first end of the flexible elongated element moves along with the user during performance of a squat exercise by the user.

7. A method of providing resistance during performance of a squat exercise by a user, wherein a belt-type device is worn by the user and includes a connection arrangement located between the user's legs, wherein the connection arrangement moves along with the user in a back-and-forth manner during performance of a squat exercise by the user, the method comprising the steps of:

providing a flexible elongated element defining a first end and a second end;

engaging the first end of the flexible elongated element with the connection arrangement and engaging the second end off the flexible elongated element with a resistance-providing element;

engaging the flexible elongated element between its first and second ends with a tracking member adapted to provide movement of the flexible elongated element in a back-and-forth manner along with the user during performance of a squat exercise; and arranging the resistance-providing element such that it exerts a rearward force on the tracking member through the flexible elongated element, the rearward force exerted on the tracking member tending and to move the tracking member in a rearward direction.

* * * * *